United States Patent [19]

Corbin et al.

[11] 4,241,625

[45] Dec. 30, 1980

[54] METHOD OF MAKING A WIRE DRAWING DIE

[75] Inventors: Lawrence W. Corbin; Charles Carson, both of Ft. Wayne, Ind.

[73] Assignee: Fort Wayne Wire Die, Inc., Fort Wayne, Ind.

[21] Appl. No.: 18,649

[22] Filed: Mar. 8, 1979

[51] Int. Cl.[3] ..... B21K 5/20

[52] U.S. Cl. ..... 76/107 A; 72/467

[58] Field of Search ..... 76/107 A, 107 R, 101 B, 76/DIG. 12; 72/467

[56] References Cited

U.S. PATENT DOCUMENTS

| | | | |
|---|---|---|---|
| 2,171,323 | 8/1939 | Wyland | 76/107 A |
| 3,831,428 | 8/1974 | Wentorf, Jr. et al. | 76/107 A |
| 4,144,739 | 3/1979 | Corbin | 76/107 A |

*Primary Examiner*—Othell M. Simpson
*Assistant Examiner*—Roscoe V. Parker
*Attorney, Agent, or Firm*—Gust, Irish, Jeffers & Hoffman

[57] ABSTRACT

A metal casing is provided having flat, parallel front and back sides. A first cylindrical cavity having a bottom wall is formed in the front casing side. A cylindrical metal plug having top and bottom ends is secured by heat shrinking in the first casing cavity, the bottom end having a second, concentric cylindrical cavity formed therein and engaging the bottom wall of the cavity. A cylindrical metal blank having opposite ends and a concentric core formed of a synthetic hard, wear-resistant material, such as polycrystalline aggregate of synthetic or natural diamond or polycrystalline cubic boron nitride, is secured in the second cavity by heat shrinking with one end engaging the bottom thereof and the other end engaging the first casing cavity bottom wall. The top end of the plug and the back side of the casing have concentric countersunk openings therein respectively extending therethrough to the core, and the core has a concentric die opening formed therethrough communicating between the countersunk openings.

8 Claims, 4 Drawing Figures

FIG.1
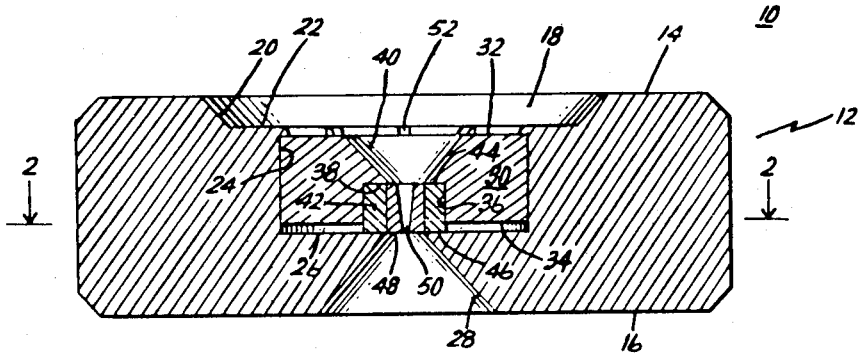
FIG.3
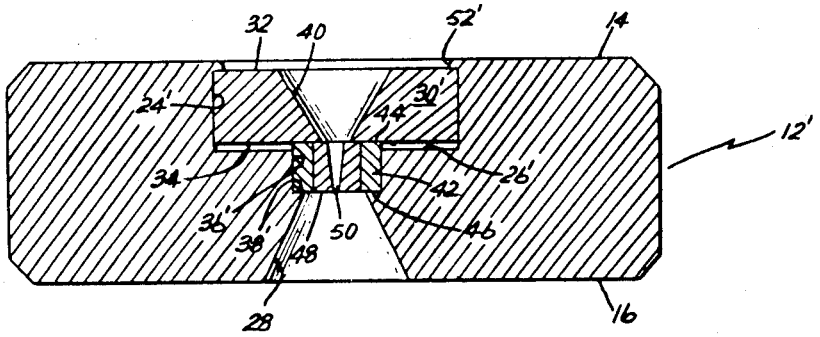
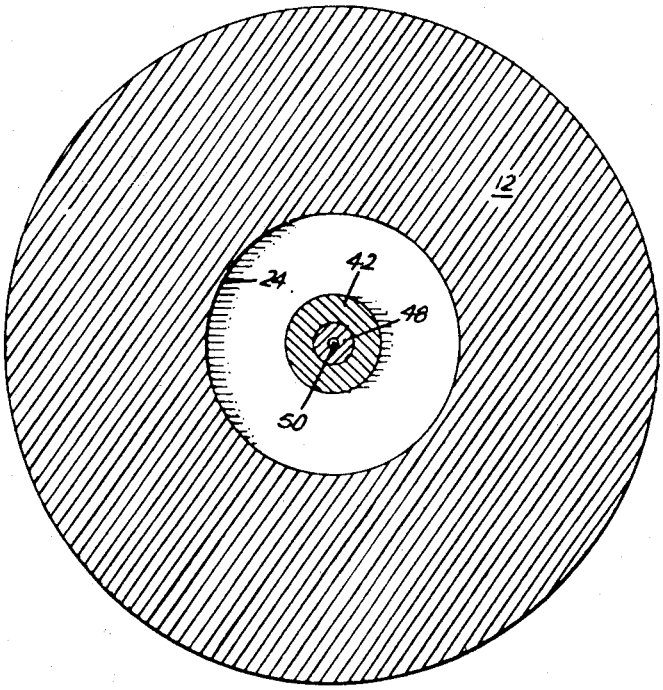
FIG.2

METHOD OF MAKING A WIRE DRAWING DIE

BACKGROUND OF THE INVENTION

1. Field of the Invention

This invention relates generally to methods of making wire drawing dies, and more particularly to a method of making a wire drawing die employing a hard, wear-resistant material. This application is related to and is an improvement on U.S. Application Ser. No. 841,886, now U.S. Pat. No. 4,144,739.

2. Description of the Prior Art

Natural diamond wire drawing dies have been manufactured for many years and typically comprise a metal casing in which the diamond is mounted, the casing in turn being adapted to be mounted in a wire drawing machine. U.S. Pat. No. 2,171,323 discloses one prior method of making a natural diamond wire drawing die.

Polycrystalline aggregates of synthetic diamond have recently become available and an annular sintered tungsten carbide blank having a core of polycrystalline aggregate of synthetic diamond is sold by the General Electric Company under the trademark "Compax". In the past, wire drawing dies employing blanks having polycrystalline aggregate of synthetic diamond cores have been shrink-fitted in a cavity in the casing; however, such shrink-fitting of the blank has required a substantial amount of skilled labor and has resulted in excessive breakage of the synthetic diamond core. A plug is shrink-fitted in the casing cavity over the blank and has the usual countersunk opening formed therethrough to the core; however, during the process of machining, the countersunk opening may extend to the outside diameter of the plug and into the surrounding casing.

The General Electric Company has even more recently introduced another synthetic hard, wear-resistant material which may be suitable for wire drawing dies, polycrystalline cubic boron nitride, referred to by the trademark "Borazon". Polycrystalline aggregate of natural diamond may also be suitable for wire drawing dies.

It is therefore desirable to provide a wire drawing die employing a hard, wear-resistant material, such as polycrystalline aggregate of synthetic or natural diamond or polycrystalline cubic boron nitride, and a method of making the same which eliminates prior problems involved in shrink-fitting of the blank in the casing, reduces breakage in the core, and eliminates the problem of the countersunk opening in the plug extending into the casing.

SUMMARY OF THE INVENTION

The improved method of making a wire drawing die of the invention, in its broader aspects, comprises providing a metal casing having front and back sides and forming a first cavity in the front casing side, the first cavity having a flat bottom wall and a cylindrical side wall extending from the front casing side to the bottom wall. A metal plug is provided having flat top and bottom ends and a cylindrical surface extending between the ends, and a second cavity is formed in one of the first cavity bottom wall and plug bottom ends, the second cavity having a cylindrical side wall extending to a flat bottom. Countersunk openings are formed in the top end of the plug and the back side of the casing respectively concentric with the cavities and extending to the bottom of the second cavity and the other of the first cavity bottom wall and plug bottom end. A metal blank is provided having flat opposite ends and a cylindrical outer surface extending between the ends, the blank having a concentric core formed of hard, wear-resistant material, such as polycrystalline aggregate of synthetic or natural diamond or polycrystalline cubic boron nitride. The blank is secured in the second cavity by heat shrinking to provide an interference fit with one of the ends of the blank engaging the bottom of the second cavity, and the plug is secured in the first cavity by heat-shrinking to provide an interference fit with the other end of the blank engaging the other of the first cavity bottom wall and plug bottom ends. A die opening is drilled in the core communicating between the countersunk openings and concentric therewith.

In the preferred embodiment of the invention, a temperature in the range of about 600° F. to 1000° F. and force of about 1200 to about 2400 pounds is employed in both heat-shrinking steps.

It is accordingly an object of the invention to provide an improved method of making a wire drawing die.

Another object of the invention is to provide an improved method of making a wire drawing die employing a hard, wear-resistant material, such as polycrystalline aggregate of synthetic or natural diamond or polycrystalline cubic boron nitride.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

FIG. 1 is a cross-sectional view illustrating the improved diamond wire drawing die of the invention;

FIG. 2 is a top cross-sectional view taken generally along the line 2—2 of FIG. 1;

FIG. 3 is a cross-sectional view illustrating a modified form of the improved wire drawing die of the invention.

DESCRIPTION OF THE PREFERRED EMBODIMENTS

Figure 4:
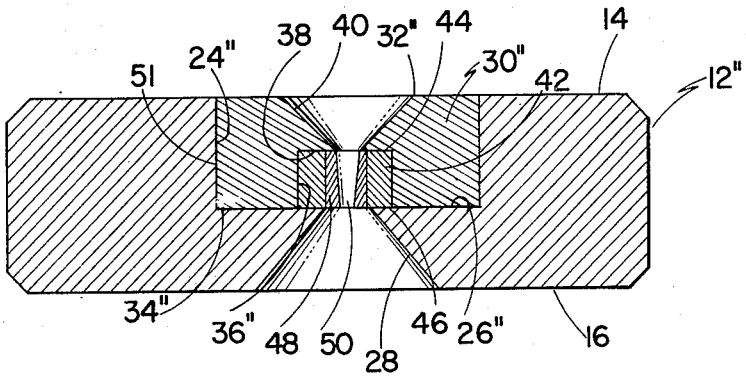
FIG. 4 is a cross-sectional view illustrating another modified form of wire drawing die made by the method of the present invention.

Referring now to FIGS. 1 and 2 of the drawing, one form of wire drawing die of the invention, generally indicated at 10, comprises a cylindrical metal casing 12, preferably, but not necessarily, formed of stainless steel, having flat, parallel, front and back sides 14, 16. Relatively shallow, annular cavity 18 is formed in front side 14 of casing 12 and has tapered side wall 20 and flat bottom wall 22 parallel with front side 14. Cylindrical cavity 24 concentric with cavity 18 is formed in bottom wall 22, cavity 24 having a smaller diameter than cavity 18, and having bottom wall 26 spaced from back casing side 16 and parallel therewith. Countersunk opening 28 is formed in back casing side 16 concentric with cavities 18, 24, and extends to bottom wall 26 of cavity 24.

Cylindrical plug 30 having top and bottom ends 32, 34, has cylindrical cavity 36 formed in bottom end 34; cavity 36 has flat bottom 38. Countersunk opening 40 is formed in top end 32 of plug 30 and extends therethrough to bottom 38 of cavity 36.

Cylindrical blank 42 having top and bottom ends 44, 46 is closely fitted in plug cavity 36 with its top end 44 engaging bottom 38 thereof; blank 42 is slightly longer than the depth of plug cavity 36. Blank 42 may be of the type sold by the General Electric Company under the trademark "Compax". Blank 42 is typically formed of sintered tungsten carbide and has core 48 concentric therein which may be formed of polycrystalline aggregate of synthetic, i.e., man-made diamond. Alternatively, core 48 may be formed of polycrystalline cubic boron nitride sold by the General Electric Company under the trademark "Borazon", or polycrystalline aggregate of natural diamond.

Plug 30, with blank 42 fitted in cavity 36, is closely fitted in cavity 24 with bottom end 46 of blank 42 engaging bottom wall 26 of casing cavity 24 and spacing bottom end 34 of plug 30 therefrom. Core 48 has die opening 50 therethrough communicating with countersunk openings 28, 40 and concentric therewith.

In the illustrated embodiment, top end 32 of plug 30 is spaced below bottom wall 22 of casing cavity 18, and plug 30 is secured in casing cavity 24 by crimping bottom wall 22 of cavity 18 at a plurality of points, as at 52. It will be readily understood that plug 30 may be secured in cavity 24 by other means, such as by being press-fitted therein or by brazing or welding.

It will now readily be seen that plug 30 is relatively wider and thinner than the plugs previously employed for mounting synthetic diamonds and thus, countersunk opening 40 does not extend to its periphery; cavity 18 in essence forms an extension of countersunk opening 40. It will further be seen that in the aforementioned U.S. Pat. No. 4,144,739 blank 42 is retained in cavity 36 in plug 30 without the necessity of heat-shrinking and thus, the breakage formerly encountered is minimized. Such breakage is also minimized while allowing a heat shrinking operation in accordance with the techniques of the present invention.

Referring now to FIG. 3 in which like elements are indicated by like reference numerals and similar elements by primed reference numerals, in certain applications, cavity 18 of the previous embodiment may not be necessary and further, the blank-retaining cavity may be formed in the casing rather than in the plug. Here, casing cavity 24' is formed in front side 14 of casing 12', and cavity 36' is formed in its bottom wall 26'. Blank 42 is closely fitted in cavity 36' with its bottom end 46 engaging bottom 38'.

Plug 30' is closely seated in casing cavity 24' with its bottom end 34 engaging top end 44 of blank 42 and being spaced thereby from bottom wall 36' of cavity 24'. Here, plug 30' is secured in cavity 24' by a continuous crimp 52'. As in the case of the previous embodiment, countersunk openings 28, 40 are formed in casing 12' and plug 30' prior to assembly; here, countersunk opening 28 extends to bottom 38' of cavity 36', and countersunk opening 40 extends to bottom end 34 of plug 30'. Die opening 50 communicates with countersunk openings 28, 40.

It has been found that with the wire drawing die construction of the type shown in FIGS. 1, 2 and 3, heat-shrinking can be employed to secure the blank in the second cavity, and to secure the plug in the first cavity in order to increase the interference fit without the breakage of the synthetic diamond core previously encountered. The temperature employed in such heat-shrinking should not generally exceed the manufacturer's recommended maximum working temperature, about 1200° F. in the case of the General Electric Company Compax blanks, however, experience has shown that higher temperatures can be used with care.

Referring now to FIG. 4 in which like elements are indicated by like reference numerals and similar elements by double primed reference numerals, a modified form of wire drawing die in accordance with the invention is shown in which heat-shrinking is employed in assembly of the die. Here, cylindrical metal casing 12'', again preferably, but not necessarily, formed of stainless steel, again has flat, parallel, front and back sides 14, 16. Cylindrical cavity 24'' is formed in front side 14 of casing 12'' and has bottom wall 26'' spaced from back casing side 16 and parallel therewith. Countersunk opening 28 is formed in back casing side 16 concentric with cavity 24'' and extends to bottom wall 26''.

Cylindrical plug 30'' having top and bottom ends 32'', 34'' has cylindrical cavity 36'' formed in bottom end 34'', cavity 36'' having flat bottom 38. Countersunk opening 40 is formed in top end 32'' of plug 30'' and extends therethrough to bottom 38 of cavity 36''.

Cylindrical blank 42 having top and bottom ends 44, 46 is provided which may be of the type sold by the General Electric Company under the trademark "Compax". Blank 42 is typically formed of sintered tungsten carbide and has core 48 concentric therewith which may be formed of polycrystalline aggregate of synthetic, i.e., man-made diamond. Alternatively, core 48 may be formed of polycrystalline cubic boron nitride sold by the General Electric Company under the trademark "Borazon" or polycrystalline aggregate of natural diamond. In this embodiment, the thickness of blank 42 is substantially the same as the depth of cavity 36''.

In accordance with the method of the invention, blank 42 is secured in cavity 36'' by heat-shrinking to provide an interference fit. Temperature in the range of about 600° F. to about 1000° F. and force in the range of about 1200 to about 2400 pounds may be employed.

Following the securing of blank 42 in cavity 36'' as above-described with end 44 of blank 42 in engagement with bottom 38 of cavity 36'', side wall 51 of plug 30'' is preferably machined, as by use of a centerless grinder, since plug 30'' may have a slight bulge due to the application of heating and pressure in the securing of blank 42 in cavity 36'' by heat-shrinking as above-described. In the event that bottom end 46 of blank 42 lies below bottom end 34'' of plug 30'', bottom end 34'' is preferably machined so as to be flush with the bottom end 46 of blank 42.

Plug 30'' with blank 42 secured in cavity 36'', as above-described, is then secured in cavity 24'' by heat-shrinking to provide an interference fit, as in the case of the securing of blank 42 in cavity 36''. The same range of temperatures and pressures may be employed as in securing blank 42 in cavity 36''.

In this embodiment, crimping 52, 52' employed in the embodiments of FIGS. 1 and 3 is optional and may be eliminated in the event that the casing dimensions preclude crimping.

It will be readily apparent that, as in the case of the previous embodiments, cavity 36'' may be formed in bottom wall 26'' of cavity 24'' rather in bottom end 34'' of plug 30''. In this embodiment, it will be observed that blank 42 does not protrude beyond bottom end 34'' of plug 30'', or bottom wall 26'' of cavity 24'', as the case may be, and that bottom end 34'' of plug 30'' and that bottom end 34'' of plug 30'' engages bottom wall 26'' of cavity 24'', it having been found that protrusion of the die blank 42, as shown in FIGS. 1 through 3, may result in some breakage and also may not be necessary to prevent spinning of the blank 42 in the event of an insufficient interference fit thereof in cavity 36.

While there have been described above the principles of this invention in connection with specific apparatus and methods, it is to be clearly understood that this description is made only by way of example and not as a limitation to the scope of the invention.

What is claimed is:

1. The method of making a wire drawing die comprising the steps of: providing a metal casing having front and back sides; forming a first cavity in said front casing side having a flat bottom wall and a cylindrical side wall extending from said front casing side to said bottom wall; providing a metal plug having flat top and bottom ends and a cylindrical outer surface extending between said ends; forming a second cavity in one of said first cavity bottom wall and said plug bottom end, said second cavity having a cylindrical side wall extending to a flat bottom; forming countersunk openings in said top end of said plug and said back side of said casing respectively concentric with said cavities and extending to said bottom of said second cavity and the other of said first cavity bottom wall and said plug bottom end; providing a metal blank having flat opposite ends and a cylindrical outer surface extending between said ends, said blank having a concentric core formed of hard, wear-resistant material; securing said blank in said second cavity by heat-shrinking to provide an interference fit therewith and with one end of said blank engaging the bottom of said second cavity; securing said plug in said first cavity by heat-shrinking to provide an interference fit therewith and with the other end of said blank engaging the other of said first cavity bottom wall and plug bottom end; carrying out both said heat-shrinking steps employing a temperature of about 600° F. to 1,000° F. and a force of about 1,200 to about 2,400 pounds; and drilling a die opening in said core communicating between said countersunk openings and concentric therewith.

2. The method of making a wire drawing die comprising the steps of: providing a metal casing having front and back sides; forming a first cavity in said front casing side having a flat bottom wall and a cylindrical side wall extending from said front casing side to said bottom wall; providing a metal plug having flat top and bottom ends and a cylindrical outer surface extending between said ends; forming a second cavity in one of said first cavity bottom wall and said plug bottom end, said second cavity having a cylindrical side wall extending to a flat bottom; forming countersunk openings in said top end of said plug and said back side of said casing respectively concentric with said cavities and extending to said bottom of said second cavity and the other of said first cavity bottom wall and said plug bottom end; providing a metal blank having flat opposite ends and a cylindrical outer surface extending between said ends, said blank having a concentric core formed of hard, wear-resistant material; securing said blank in said second cavity by heat-shrinking to provide an interference fit therewith and with one end of said blank engaging the bottom of said second cavity; machining the outer surface of said plug for concentricity following the step of securing said blank in said second cavity; securing said plug in said first cavity by heat-shrinking to provide an interference fit therewith and with the other end of said blank engaging the other of said first cavity bottom wall and plug bottom end; and drilling a die opening in said core communicating between said countersunk openings and concentric therewith.

3. The method of claim 2 wherein a temperature of about 600° F. to 1000° F. and force of about 1200 to about 2400 pounds is employed in both said heat-shrinking steps.

4. The method of claim 2 wherein said bottom end of said plug engages said first cavity bottom wall following securing said plug in said first cavity.

5. The method of making a wire drawing die comprising the steps of: providing a metal casing having front and back sides; forming a first cavity in said front casing side having a flat bottom wall and a cylindrical side wall extending from said front casing side to said bottom wall; providing a metal plug having flat top and bottom ends and a cylindrical outer surface extending between said ends; forming a second cavity in one of said first cavity bottom wall and said plug bottom end, said second cavity having a cylindrical side wall extending to a flat bottom; forming countersunk openings in said top end of said plug and said back side of said casing respectively concentric with said cavities and extending to said bottom of said second cavity and the other of said first cavity bottom wall and said plug bottom end; providing a metal blank having flat opposite ends and a cylindrical outer surface extending between said ends, said blank having a concentric core formed of hard, wear-resistant material; securing said blank in said second cavity by heat-shrinking to provide an interference fit therewith and with one end of said blank engaging the bottom of said second cavity; securing said plug in said first cavity by heat-shrinking to provide an interference fit therewith with the bottom end of said plug engaging said first cavity bottom wall and with the other end of said blank engaging the other of said first cavity bottom wall and plug bottom end; and drilling a die opening in said core communicating between said countersunk openings and concentric therewith.

6. The method of claim 5 wherein the thickness of said blank is no greater than the depth of said second cavity.

7. The method of claim 6 wherein said second cavity is formed in said bottom end of said plug; and comprising the further step of machining said bottom end of said plug following securing said blank in said second cavity so that said plug bottom end is flush with said other end of said blank.

8. The method of making a wire drawing die comprising the steps of: providing a metal casing having front and back sides; forming a first cavity in said front casing side having a flat bottom wall and a cylindrical side wall extending from said front casing side to said bottom wall; providing a metal plug having flat top and bottom ends and a cylindrical outer surface extending between said ends; forming a second cavity in said plug bottom end, said second cavity having a cylindrical side wall extending to a flat bottom; forming countersunk openings in said top end of said plug and said back side of said casing respectively concentric with said cavities and extending to said bottom of said second cavity and the other of said first cavity bottom wall and said plug bottom end; providing a metal blank having flat opposite ends and a cylindrical outer surface extending between said ends, said blank having a concentric core formed of hard, wear-resistant material; securing said blank in said second cavity by heat-shrinking to provide an interference fit therewith and with one end of said blank engaging the bottom of said second cavity; machining said bottom end of said plug following the securing of said blank in said second cavity so that said plug bottom end is flush with said other end of said blank; securing said plug in said first cavity by heat-shrinking to provide an interference fit therewith and with the other end of said blank engaging the other of said first cavity bottom wall and plug bottom end; and drilling a die opening in said core communicating between said countersunk openings and concentric therewith.

* * * * *